US006763982B1

(12) United States Patent
Livornese

(10) Patent No.: US 6,763,982 B1
(45) Date of Patent: Jul. 20, 2004

(54) HOSIERY REMOVAL AND RETRIEVAL TOOL WITH A NOTCH FOR SHOE REMOVAL AND A SHOEHORN

(76) Inventor: George Livornese, 20 Link Rd., Staten Island, NY (US) 10304

( * ) Notice: Subject to any disclaimer, the term of this patent is extended or adjusted under 35 U.S.C. 154(b) by 0 days.

(21) Appl. No.: 10/361,330

(22) Filed: Feb. 10, 2003

(51) Int. Cl.[7] ..... A47G 25/82
(52) U.S. Cl. ..... 223/118; 223/111
(58) Field of Search ..... D2/641; 223/111, 223/118

(56) References Cited

U.S. PATENT DOCUMENTS

| | | | | |
|---|---|---|---|---|
| 594,894 A | * 12/1897 | Nylander | ..... | 223/118 |
| 3,396,882 A | 8/1968 | Berlin | ..... | 223/111 |
| 3,853,252 A | 12/1974 | Scianimanico | ..... | 223/111 |
| D259,299 S | 5/1981 | Vreeken | ..... | D2/378 |

* cited by examiner

*Primary Examiner*—John J. Calvert
*Assistant Examiner*—James G Smith
(74) *Attorney, Agent, or Firm*—Goldstein Law Offices, P.C.

(57) ABSTRACT

A hosiery removal and retrieval tool with a notch for shoe removal and a shoehorn, for use by individuals with limited mobility. The tool has a substantially cylindrical elongated shank having a first end and a second end. The first end of the shank terminates in a rounded portion, having a substantially cylindrical prong which extends from the shank at an angle, and also having a notch. The prong is used for pushing socks or stockings off the foot of the user. The notch is used for pushing a shoe off the foot of the user. The prong additionally has a rough strip located on a portion of its surface for aiding a user in retrieving hosiery once it has been removed by use of the prong. The second end of the shank has a shoehorn, for aiding a user in putting the shoe onto the foot.

5 Claims, 3 Drawing Sheets

HOSIERY REMOVAL AND RETRIEVAL TOOL WITH A NOTCH FOR SHOE REMOVAL AND A SHOEHORN

BACKGROUND OF THE INVENTION

1. Field of the Invention

The invention relates to a hosiery removal and retrieval tool which includes a notch for shoe removal and also a shoehorn.

2. Description of the Related Art

A great many elderly and disabled people are limited in their ability to perform ordinary activities. In particular, removal of socks, stockings, and shoes, may be difficult for these individuals because of their limited ability to stretch or bend. Additionally, it may be difficult for these individuals to put on a pair of shoes, or to retrieve hosiery once it has been removed from the feet. Accordingly, there is a need for a hosiery removal and retrieval tool for helping individuals with limited mobility to remove and retrieve socks and stockings, which also includes a notch for removing shoes, and a shoehorn for putting on a pair of shoes.

A variety of hosiery removal tools are available. U.S. Pat. No. 3,396,882 to Berlin appears to show a hosiery removal tool comprised of an elongated shank with a handle and plate containing a U-shaped configuration. Additionally, U.S. Pat. No. 3,853,252 to Scianimanico appears to show a hosiery removal tool comprised of a U-shaped member and a pair of handles. Moreover, U.S. Pat. No. D259,299 to Vreeken appears to show an ornamental design for a hosiery removal tool for the handicapped.

None of these devices appears to show a hosiery removal and retrieval tool having a prong and a notch on one end, for aiding a user in removing hosiery and shoes, respectively, a rough portion on the prong for retrieving hosiery after removal, and a shoehorn at the opposite end.

While these units may be suitable for the particular purpose employed, or for general use, they would not be as suitable for the purposes of the present invention as disclosed hereafter.

SUMMARY OF THE INVENTION

It is an object of the invention to provide a hosiery removal and retrieval tool which enables a user to remove socks or stockings from his/her feet without having to stretch excessively or to bend at the waist. Accordingly, the tool has an elongated shank with a cylindrical prong attached to one end, which enables the user to push the sock off the foot without having to stretch excessively or to bend at the waist.

It is another object of the invention to provide a hosiery removal and retrieval tool which allows a person to retrieve hosiery once it has been removed by use of the tool. Accordingly, the tool has a rough strip located upon the cylindrical prong, whereby the user may pick up and retrieve hosiery once it has been removed from the feet.

It is yet another object of the invention to provide a hosiery removal and retrieval tool which also helps individuals with limited mobility to remove shoes from the feet. Accordingly, the tool has a rounded notch located in proximity to the cylindrical prong by which a user may push a shoe off a foot.

It is still another object of the invention to provide a hosiery removal and retrieval tool which may also be used to help an individual with limited mobility to put a shoe onto a foot. Accordingly, the tool has a shoehorn located on an opposite end of the elongated shank from that of the cylindrical prong, to assist the user in putting the shoe onto the foot.

The invention is a hosiery removal and retrieval tool with a notch for shoe removal and a shoehorn, for use by individuals with limited mobility. The tool has a substantially cylindrical elongated shank having a first end and a second end. The first end of the shank terminates in a rounded portion, having a substantially cylindrical prong which extends from the shank at an angle, and also having a notch. The prong is used for pushing socks or stockings off the foot of the user. The notch is used for pushing a shoe off the foot of the user. The prong additionally has a rough strip located on a portion of its surface for aiding a user in retrieving hosiery once it has been removed by use of the prong. The second end of the shank has a shoehorn, for aiding a user in putting the shoe onto the foot.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
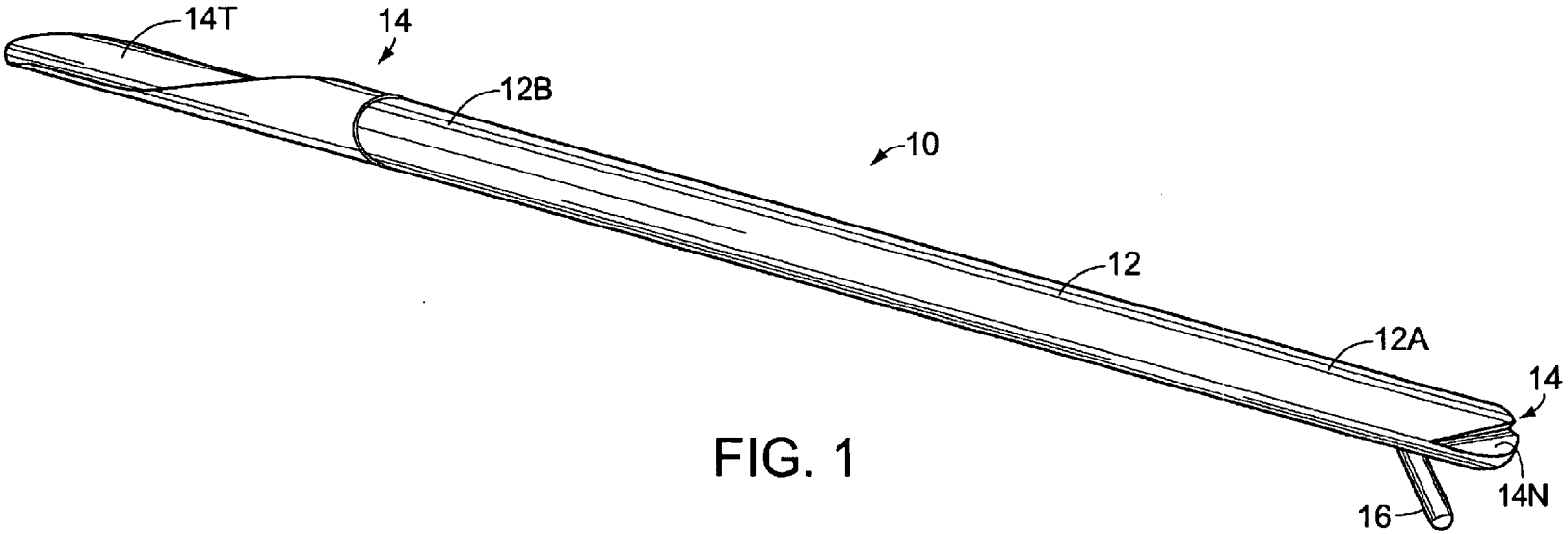
FIG. 1 is a perspective view of the hosiery removal tool 10.

FIG. 1 illustrates a perspective view of the hosiery removal and retrieval tool 10. The tool 10 has a substantially cylindrical elongated shank 12 having a first end 12A and a second end 12B. The first end 12A terminates in a rounded portion 14 having a notch 14N, and also having a substantially cylindrical prong 16 which extends from the shank 12 in proximity to the rounded portion 14 at substantially a forty-five degree angle. The notch 14N is used to push a shoe off the foot of a user. The prong 16 is used for pushing socks or stockings off the foot of the user. The prong 16 has an internally oriented surface 16I which faces the shank 12, and also an externally oriented surface 16E facing away from the shank 12. The second end 12B has a shoehorn 14, having a tapered end 14T, for helping the user put a shoe onto the foot.

Figure 2:
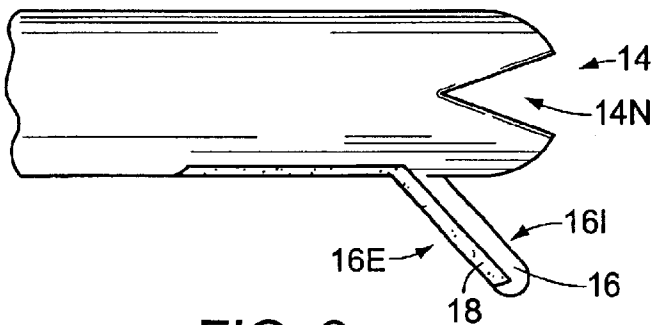
FIG. 2 is an enlarged perspective view of the first end of the hosiery removal tool.

FIG. 2 illustrates an enlarged perspective view of the first end 12A of the hosiery removal tool 10. The prong 16 has a rough strip 18 located along the externally oriented surface 16E of the prong 16 for aiding in the retrieval of hosiery once it has been removed by the prong 16. The rough strip 18 on the prong 16 also partially extends along an adjacent portion of the shank 12 in the direction of the second end 12B of the shank 12.

Figure 3:
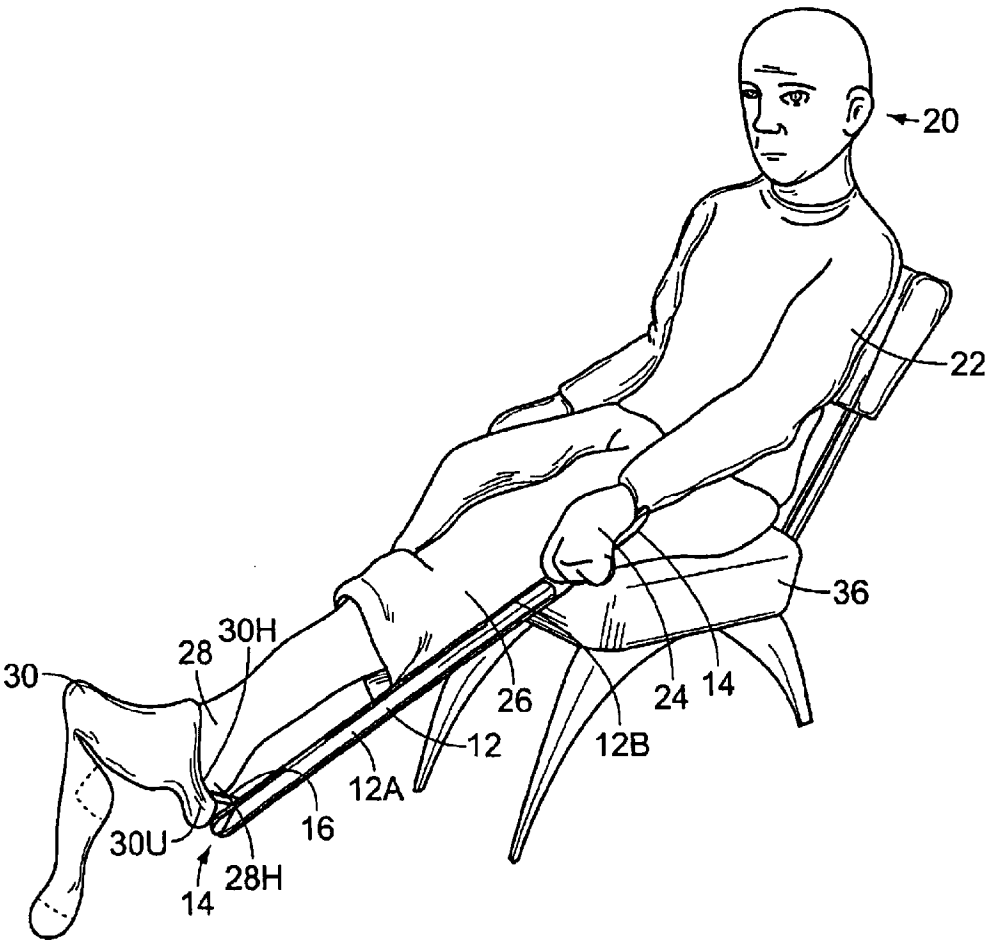
FIG. 3 is a perspective view of the tool being used to remove a sock from a foot of a user.

FIG. 3 illustrates a perspective view of the tool 10 being used by a user 20 having a leg 26 having a foot 28 having a heel 28H, and also having an arm 22 having a hand 24, while sitting on a chair 34. The user 20 is removing a sock 30 from the foot 28. The sock 30 has an upper portion 30U and an opening 30H in the upper portion 30U. The user 20 is holding the second end 12B of the tool 10 in his hand 24 and has extended the prong 16 between the opening 30H in the upper portion 30U of the sock 30 and the foot 28. The sock 30 has been substantially pushed off the foot 28 of the user 20 by pushing the second end 12B of the shank 12 toward the heel 28H of the foot 28.

Figure 4:
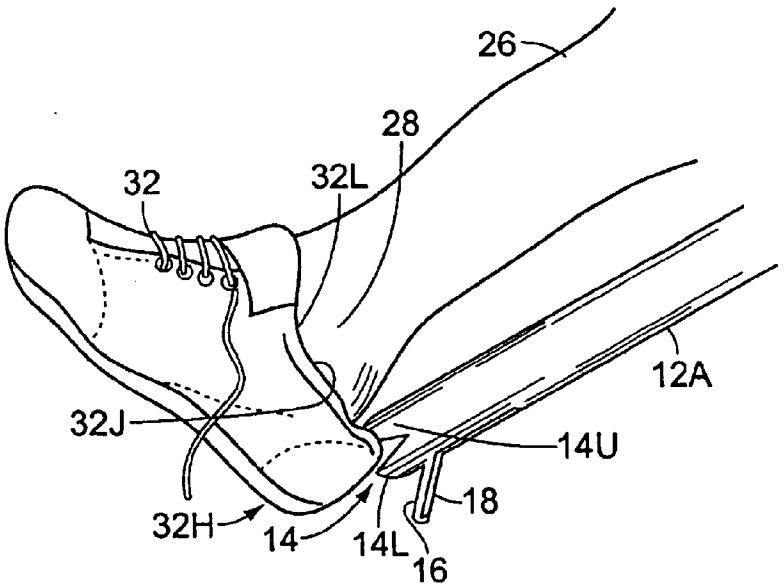
FIG. 4 is a perspective view of the tool being used to remove a shoe from a foot of a user.

FIG. 4 illustrates a perspective view of the rounded notch 14 of the tool 10 being used to push a shoe 32 from a foot 28 of the user. The notch 14 has an upper edge 14U and a lower edge 14L. The shoe 32 has a heel 32H and also an opening 32J into which the user extends the foot 28 when putting on the shoe 32. The opening 32J of the shoe 32 is encircled by a lip 32L of the shoe 32. The upper edge 14U and the lower edge 14L of the notch 14 have been extended over a portion of the lip 32L. The shoe 32 has been partially removed from the foot 28 by pushing the second end 12B of the shank 12 toward the heel 32H of the shoe 32.

Figure 5:
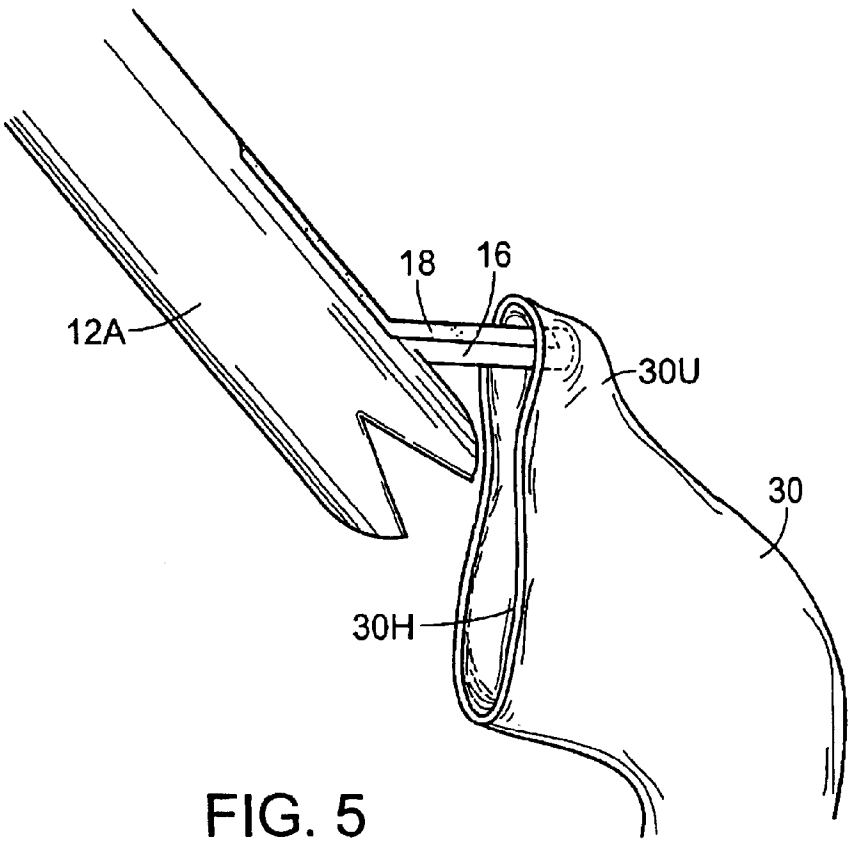
FIG. 5 is a perspective view of the tool being used to retrieve a sock.

FIG. 5 illustrates a perspective view of the rough strip 18 on the externally oriented surface 16E of the prong 16 being used to retrieve a sock 30. In particular, the prong 16 has been extended within the opening 30H in the sock 30, and the rough strip 18 prevents the sock 30 from easily slipping off of the prong 16 once it has been so engaged by the prong 16.

The hosiery removal and retrieval tool 10 is available in two sizes. The longer embodiment is thirty-six inches long and the shorter embodiment is eighteen inches long. The width of the tool 10 is approximately ¾ inches. The shank 12 is preferably constructed from wood. The shoehorn 14 is preferably constructed from plastic or metal.

To use the tool 10 to remove a shoe 32 from the foot 28 of a user, the user 20 holds the second end 12B of the shank 12 in the hand 24, engages the upper edge 14U and the lower edge 14L of the notch 14 over the lip 32L surrounding the opening 32J of the shoe 32, and pushes the tool 10 towards the heel 32H of the shoe 32. The user 20 may then remove the sock 30 from the foot 28 by extending the prong 16 between the leg 26 of the user 20 and the sock 30, and by then pushing the tool 10 towards the heel 28H of the foot 28. After removing the sock 30 from the foot 28, the user 20 may retrieve the sock 30, after hooking the sock 30 by extending the prong 16 within the opening 30H of the sock 30. The rough strip 18 on the prong 16 prevents the sock 30 from easily falling from the prong 16. The user 20 may also use the tool 10 to help put a shoe 32 onto the foot 28 by extending the tapered portion 14T of the shoe horn 14 into the opening 32J of the shoe 32 prior to insertion of the foot 28 into the opening 32J, so that the foot 28 is able to more easily slide into the opening 32J.

In conclusion, herein is presented a hosiery removal and retrieval tool with a notch for shoe removal and also a shoehorn. The invention is illustrated by example in the drawing figures, and throughout the written description. It should be understood that numerous variations are possible, while adhering to the inventive concept. Such variations are contemplated as being a part of the present invention.

What is claimed is:

1. A hosiery removal and retrieval tool for use by a user having at least one foot, said foot being covered by hosiery and also by a shoe, comprising a substantially cylindrical elongated shank having a first end and a second end, wherein the first end terminates in a rounded portion, the tool further having a substantially cylindrical prong extending from the shank and forming an acute angle with the shank at the first end thereof for pushing hosiery off the foot of the user, said first end also having a notch for pushing the shoe off the foot of the user, wherein the prong at the first end of the hosiery removal tool has an internally oriented surface which substantially faces the elongated shank of the tool, and an externally oriented surface which substantially faces away from the elongated shank, and wherein said prong has a rough strip located on said externally oriented surface for aiding a user in retrieving hosiery once it has been removed by the prong.

2. The hosiery removal tool as recited in claim 1, wherein the rough strip is comprised of a strip of sandpaper.

3. The hosiery removal tool as recited in claim 2, wherein the second end of the elongated shank has a shoehorn having a tapered end, for aiding a user in putting a shoe onto a foot.

4. A method of using a hosiery removal and retrieval tool by a user having at least one arm having a hand and at least one leg having a foot, for removing a shoe and a sock from the foot of the user, said foot having a heel portion and a toe portion, said shoe having a heel portion and an opening located above the heel portion for insertion of the foot therein, said shoe also having a lip which encircles said opening of said shoe, said sock having an opening located in proximity to the upper portion of the sock for insertion of the foot therein, said hosiery removal tool having a substantially cylindrical elongated shank having a first end and a second end, wherein the first end terminates in a rounded portion having a substantially cylindrical prong extending from the shank and forming an acute angle with the shank at the first end thereof, and also having a notch, and wherein the prong at the first end of the hosiery removal tool has an internally oriented surface which substantially faces the elongated shank of the tool, and also an externally oriented surface which substantially faces away from the elongated shank, and wherein said prong has a rough strip located on said externally oriented surface, comprising the steps of:

a) grasping by the hand of the user of the second end of the elongated shank;

b) directing the first end of the elongated shank toward the foot of the user;

c) engaging the notch at the first end of the elongated shank with the lip of the shoe;

d) pushing the shoe off the foot by pushing the second end of the tool with the arm and hand of said user, in the direction of the heel of the shoe;

e) positioning the prong between the upper portion of the sock and the leg;

f) removing the sock from the foot by pushing the tool with the arm and hand of said user, from the second end of the tool, in the direction of the toe portion of the foot; and g) retrieving the sock to the user by hooking the opening of the sock onto the prong and engaging the sock with the rough strip on the prong.

5. The method of using a hosiery removal tool as recited in claim 4, wherein the second end of the elongated shank further comprises a shoehorn having a tapered end, wherein the step of removing the shoe from the foot of the user is preceded by the step of putting the shoe onto the foot of the user by grasping the first end of the tool, extending the tapered end of the shoehorn into the opening of the shoe, and sliding the foot into the shoe aided by the use of the shoehorn.

* * * * *